US012497779B2

(12) United States Patent
Starr et al.

(10) Patent No.: US 12,497,779 B2
(45) Date of Patent: Dec. 16, 2025

(54) DRYWALL TRIM

(71) Applicant: Noll/Norwesco, LLC, Fife, WA (US)

(72) Inventors: David Starr, Burton, WA (US); Michael Starozhitsky, Lake Zurich, IL (US)

(73) Assignee: NOLL/NORWESCO, LLC, Fife, WA (US)

( * ) Notice: Subject to any disclaimer, the term of this patent is extended or adjusted under 35 U.S.C. 154(b) by 220 days.

(21) Appl. No.: 18/226,997

(22) Filed: Jul. 27, 2023

(65) Prior Publication Data

US 2024/0044145 A1 Feb. 8, 2024

Related U.S. Application Data

(60) Provisional application No. 63/395,527, filed on Aug. 5, 2022.

(51) Int. Cl.
*E04F 13/06* (2006.01)
*E04F 19/02* (2006.01)

(52) U.S. Cl.
CPC ..... *E04F 13/06* (2013.01); *E04F 19/02* (2013.01)

(58) Field of Classification Search
CPC ..... E04F 13/06; E04F 19/02; E04F 2013/063; E04F 2013/061
See application file for complete search history.

(56) References Cited

U.S. PATENT DOCUMENTS

| | | | | |
|---|---|---|---|---|
| 844,812 | A | 2/1907 | Knapp | |
| 1,264,812 | A * | 4/1918 | Klauer | E04F 13/06 52/257 |
| 1,361,843 | A | 12/1920 | Flagge | |
| 2,904,856 | A | 9/1959 | Robinson | |
| 5,131,198 | A * | 7/1992 | Ritchie | E04F 21/00 52/287.1 |
| 5,778,617 | A | 7/1998 | Free | |
| 10,458,122 | B2 | 10/2019 | Bodner | |
| 2002/0023400 | A1 * | 2/2002 | Smythe, Jr. | B32B 29/00 52/287.1 |
| 2002/0073638 | A1 | 6/2002 | Kunz et al. | |
| 2003/0131546 | A1 | 7/2003 | Kunz | |
| 2006/0070324 | A1 * | 4/2006 | Daly | E04F 13/06 52/287.1 |
| 2010/0215900 | A1 * | 8/2010 | Conboy | C09J 7/21 428/137 |
| 2011/0030297 | A1 * | 2/2011 | Robertson | B26F 1/384 52/287.1 |
| 2017/0314275 | A1 * | 11/2017 | Rosenthal | C09J 5/06 |

(Continued)

FOREIGN PATENT DOCUMENTS

| | | | |
|---|---|---|---|
| CN | 103451495 | A | 12/2013 |
| WO | 9625570 | A1 | 8/1996 |

(Continued)

*Primary Examiner* — Theodore V Adamos
(74) *Attorney, Agent, or Firm* — Dickinson Wright PLLC

(57) ABSTRACT

A drywall trim for protecting drywall can include a metal body having a seam with a longitudinal axis. The metal body can include wings or planar portions that extend from the seam in transverse directions relative to the longitudinal axis. The planar portions can be formed at an angle relative to each other. At least one of the planar portions can have an outer edge that is not parallel to the seam. Paper can be bonded to the metal body.

25 Claims, 13 Drawing Sheets

(56) References Cited

U.S. PATENT DOCUMENTS

| | | | | |
|---|---|---|---|---|
| 2021/0198903 | A1* | 7/2021 | Cline | E04F 13/06 |
| 2023/0046179 | A1 | 2/2023 | Neil et al. | |
| 2023/0046540 | A1 | 2/2023 | Neil et al. | |

FOREIGN PATENT DOCUMENTS

| | | | |
|---|---|---|---|
| WO | 9837290 | A1 | 8/1998 |
| WO | 9844218 | A1 | 10/1998 |
| WO | 03016648 | A1 | 2/2003 |
| WO | 2004111365 | A1 | 12/2004 |
| WO | 2018157235 | A1 | 9/2018 |

* cited by examiner

DRYWALL TRIM

This application claims priority to and the benefit of U.S. Prov. Pat. App. No. 63/395,527, filed Aug. 5, 2022, which is incorporated herein by reference in its entirety.

BACKGROUND

Field of the Disclosure

The present disclosure relates in general to interior construction drywall and, in particular, a system, method and apparatus for cornerbead trim, edge and seam finishes for protecting drywall corners.

Description of the Prior Art

Conventional drywall trim for the interiors of buildings and structures typically use cornerbead to protect the corners or other intersections of the drywall. Although many known solutions are workable, improvements in drywall trim continue to be of interest.

SUMMARY

Embodiments of a drywall trim for protecting drywall are disclosed. For example, the drywall trim can include a metal body having a seam with a longitudinal axis. The metal body can include wings or planar portions that extend from the seam in transverse directions relative to the longitudinal axis. The planar portions can be formed at an angle relative to each other. At least one of the planar portions can have an outer edge that is not parallel to the seam. Paper can be bonded to the metal body.

BRIEF DESCRIPTION OF THE DRAWINGS

Before one or more embodiments are described in detail, one skilled in the art will appreciate that they are not limited in its application to the details of construction, the arrangements of components, and the arrangement of steps set forth in the following detailed description or illustrated in the drawings and descriptions. Rather, they are capable of other embodiments and of being practiced or being carried out in various ways. Also, it is to be understood that the phraseology and terminology used herein is for the purpose of description and should not be regarded as limiting.

DETAILED DESCRIPTION

Figure 1:
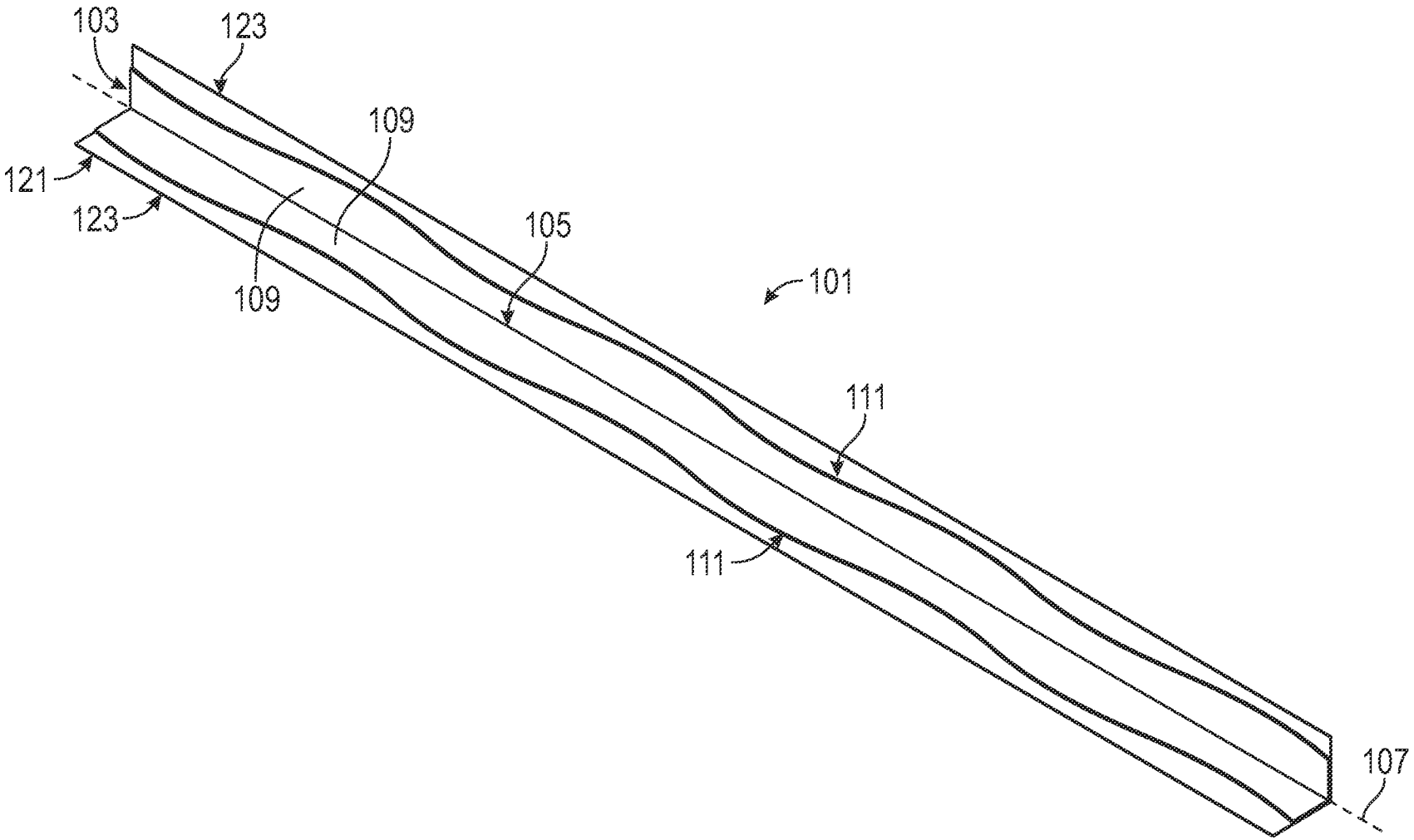
FIG. 1 is a front perspective view of a first embodiment of a cornerbead.
Figure 2:
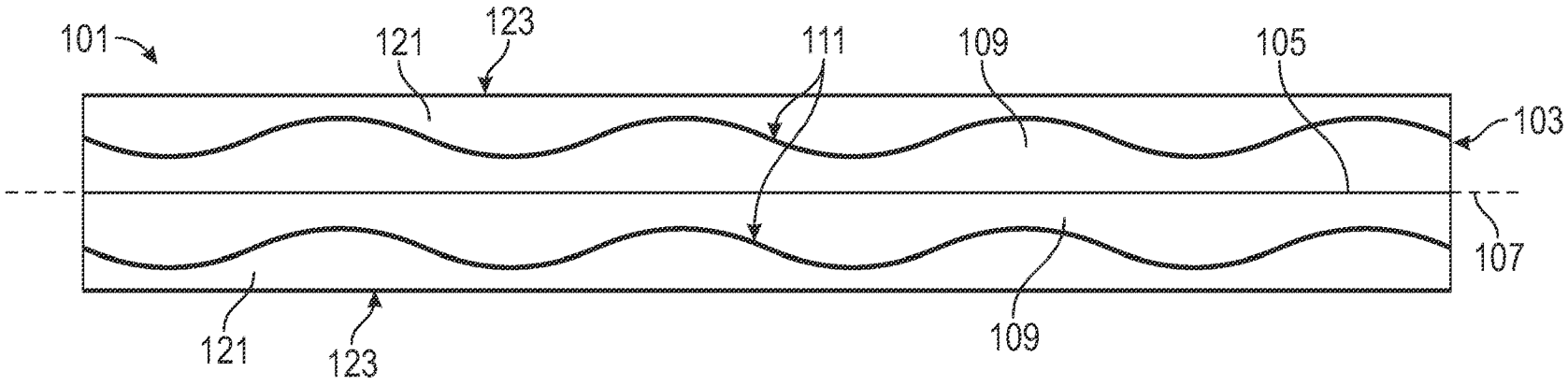
FIG. 2 is a front view of the cornerbead of FIG. 1.
Figure 3:
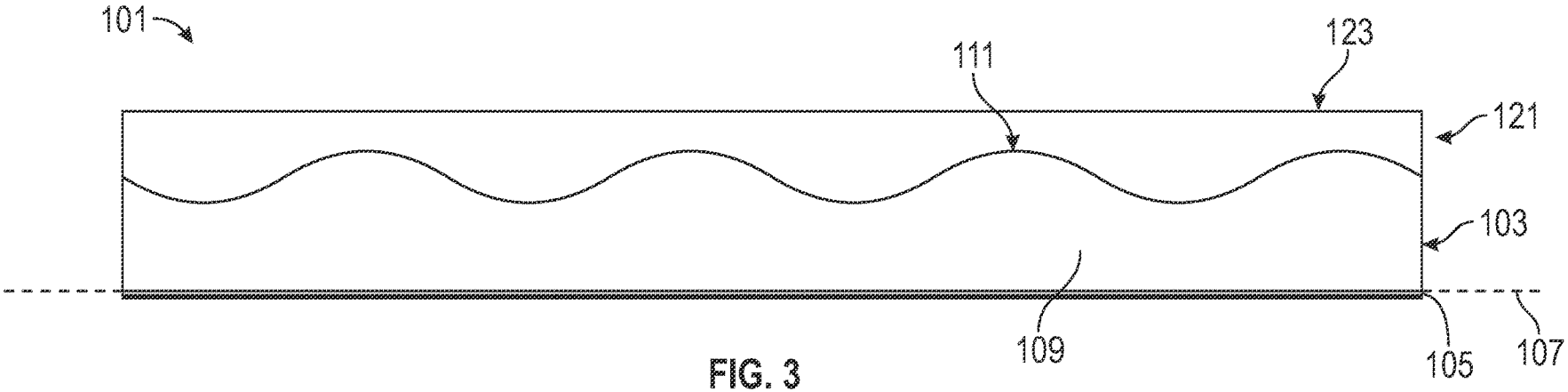
FIG. 3 is a side view of the cornerbead of FIG. 1.
Figure 4:
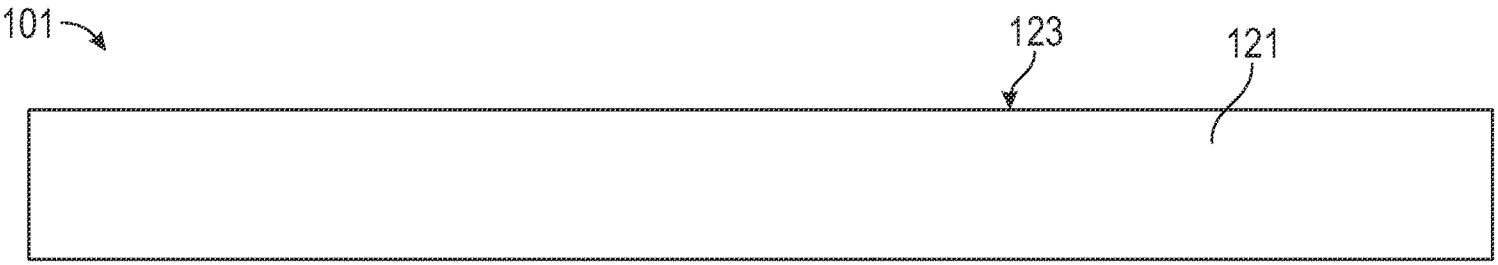
FIG. 4 is a rear view of the cornerbead of FIG. 1.
Figure 5:
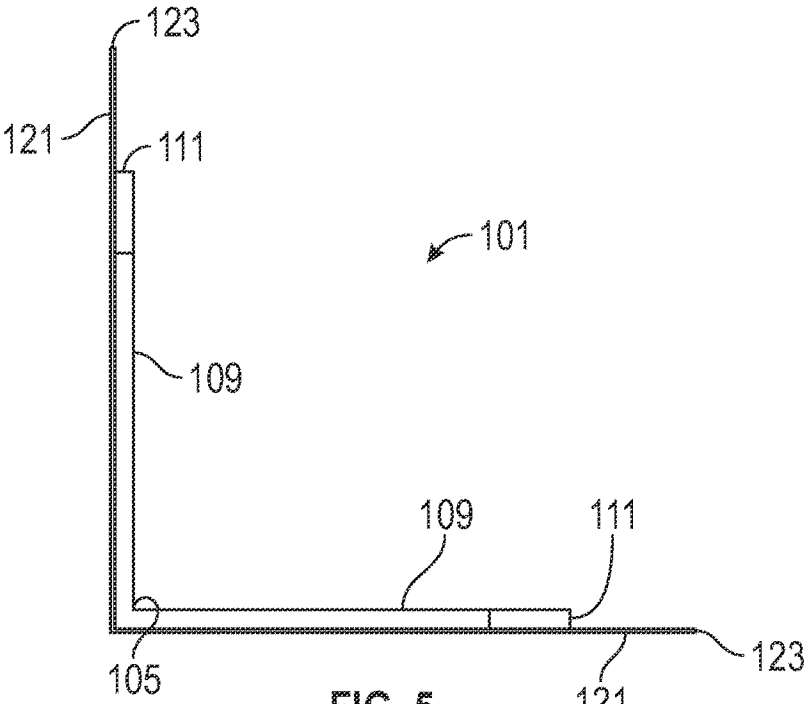
FIG. 5 is an end view of the cornerbead of FIG. 1.
Figure 6:
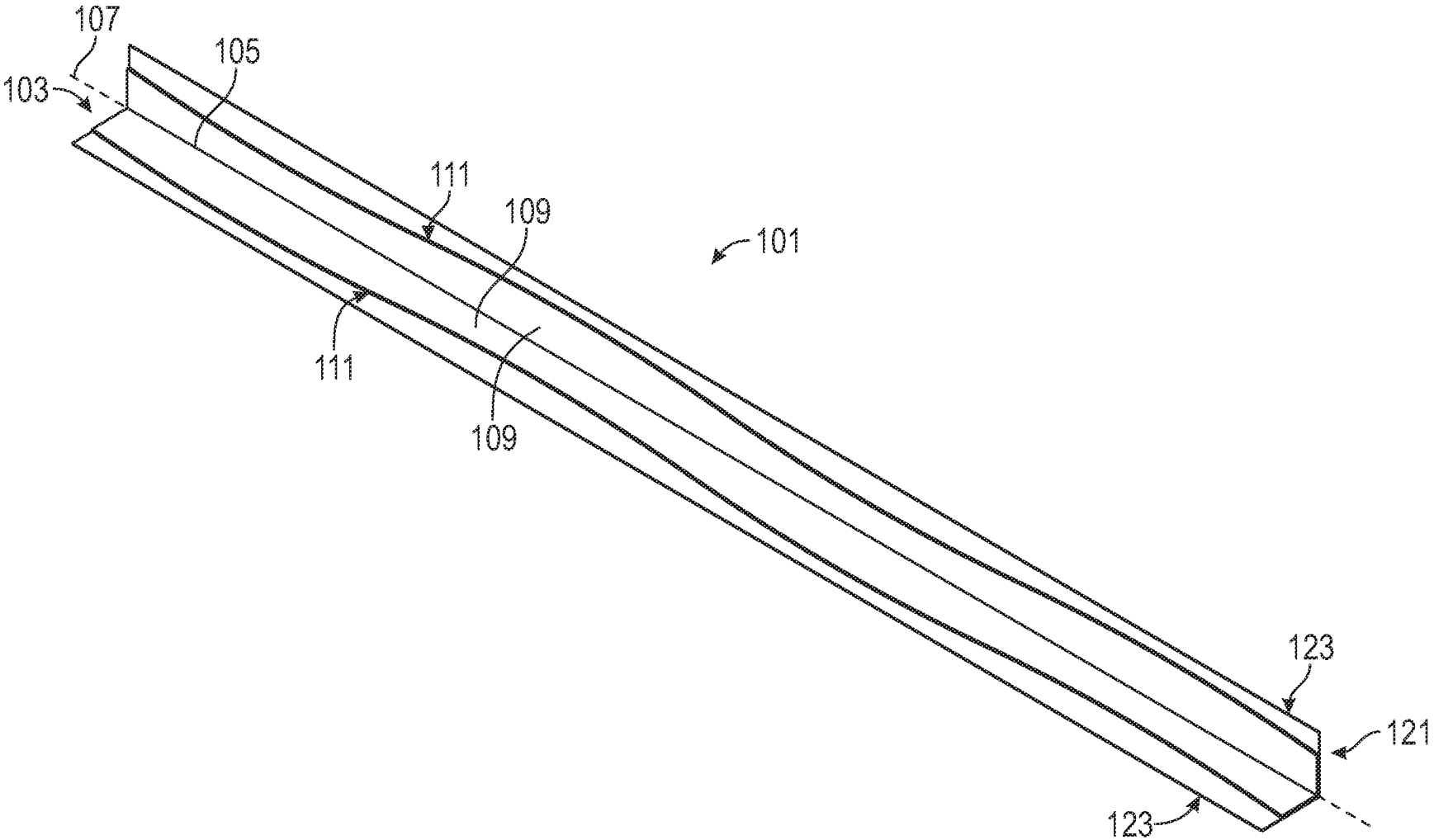
FIG. 6 is a front perspective view of a second embodiment of a cornerbead.
Figure 7:
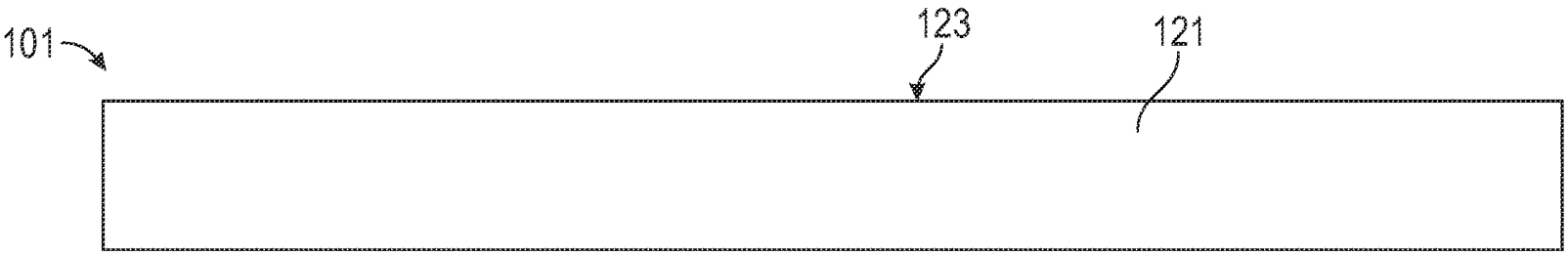
FIG. 7 is a rear view of the cornerbead of FIG. 6.
Figure 8:
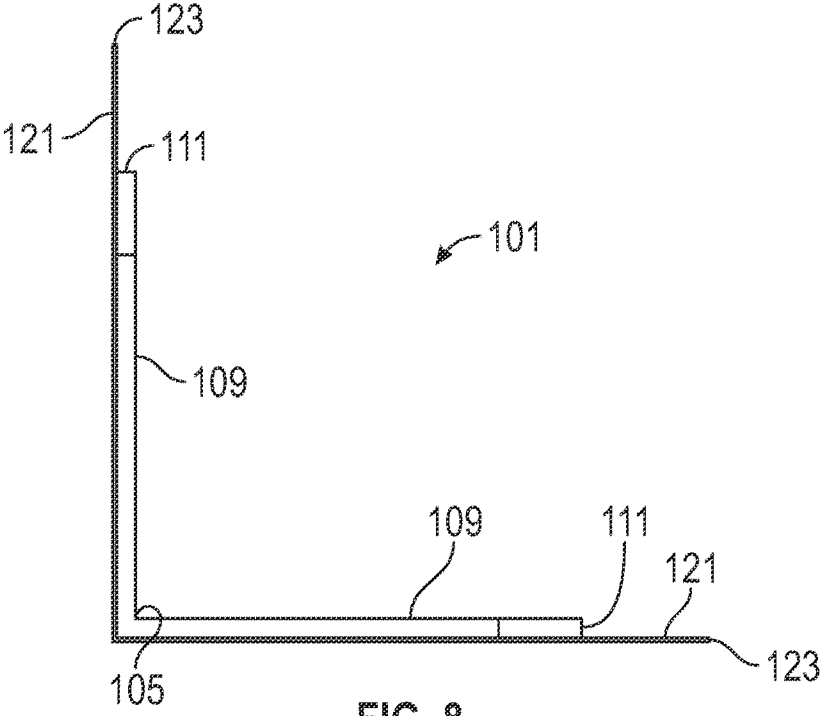
FIG. 8 is an end view of the cornerbead of FIG. 6.
Figure 9:
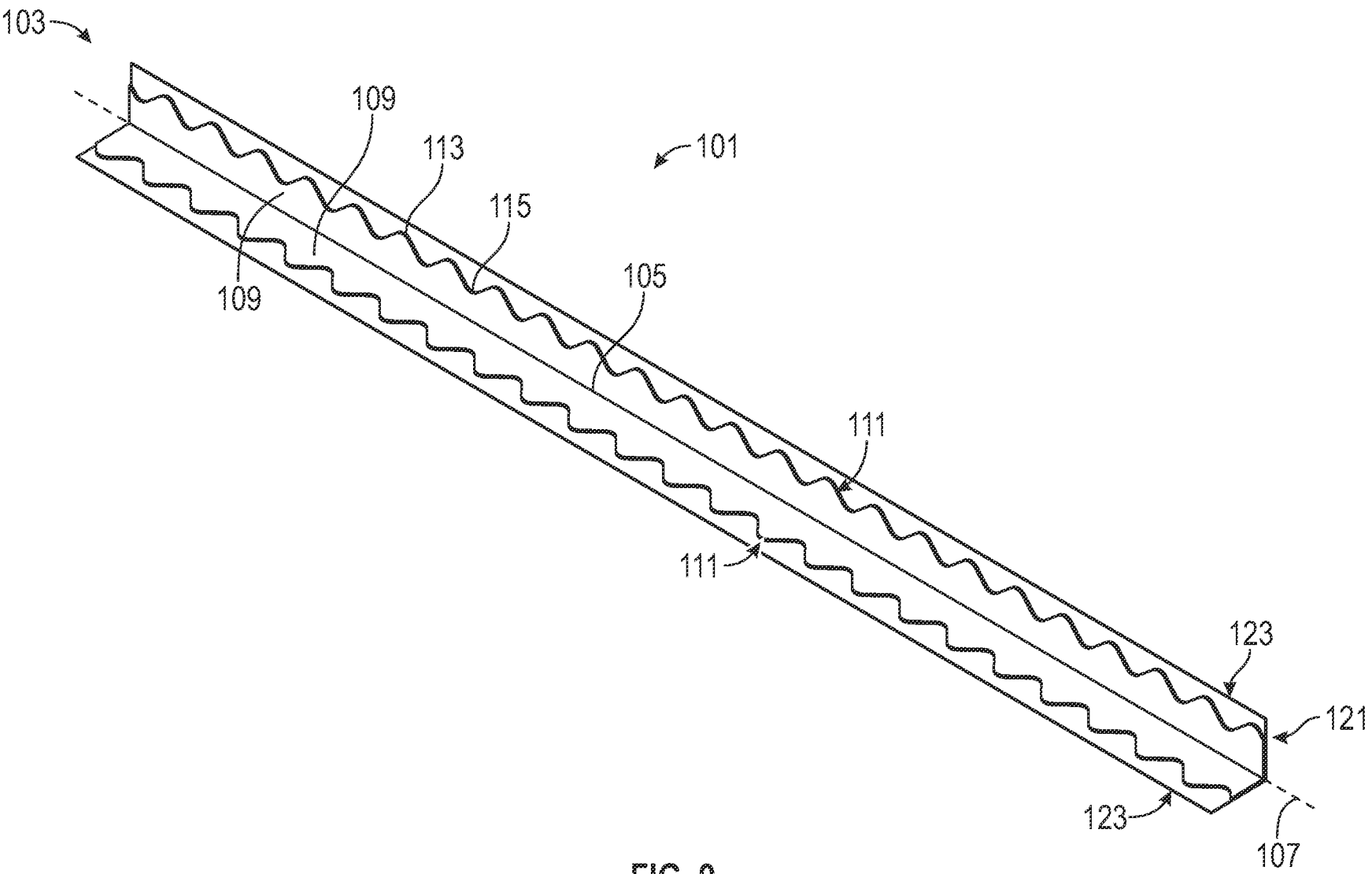
FIG. 9 is a front perspective view of a third embodiment of a cornerbead.
Figure 10:
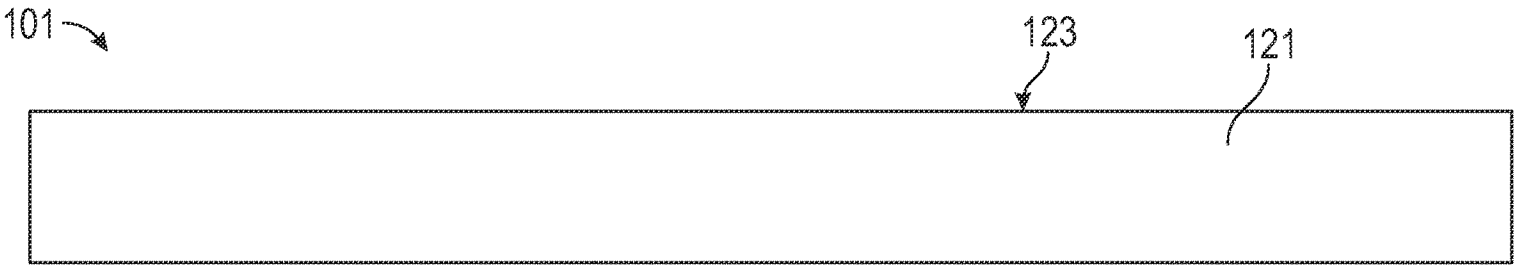
FIG. 10 is a rear view of the cornerbead of FIG. 9.
Figure 11:
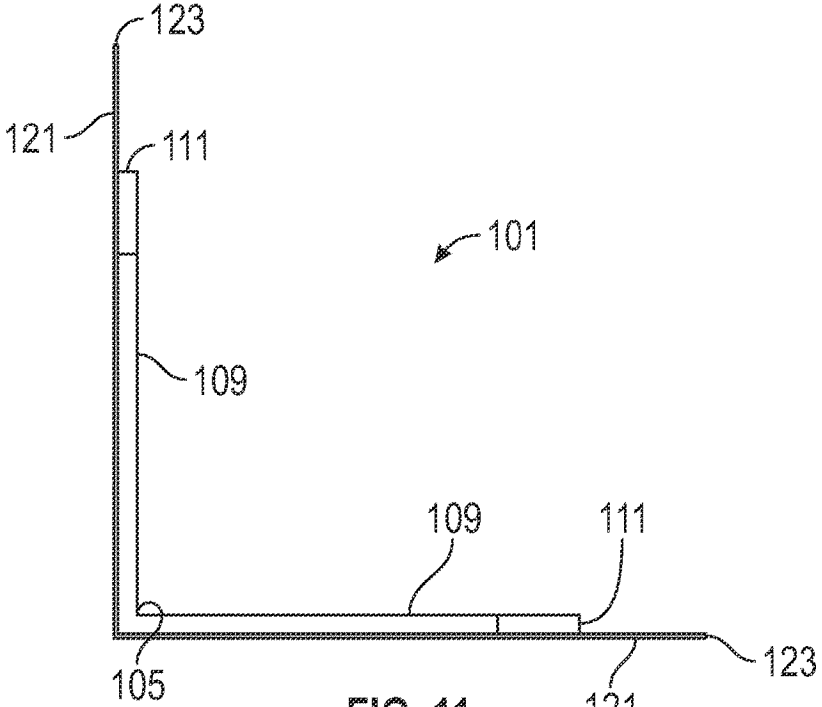
FIG. 11 is an end view of the cornerbead of FIG. 9.
Figure 12:
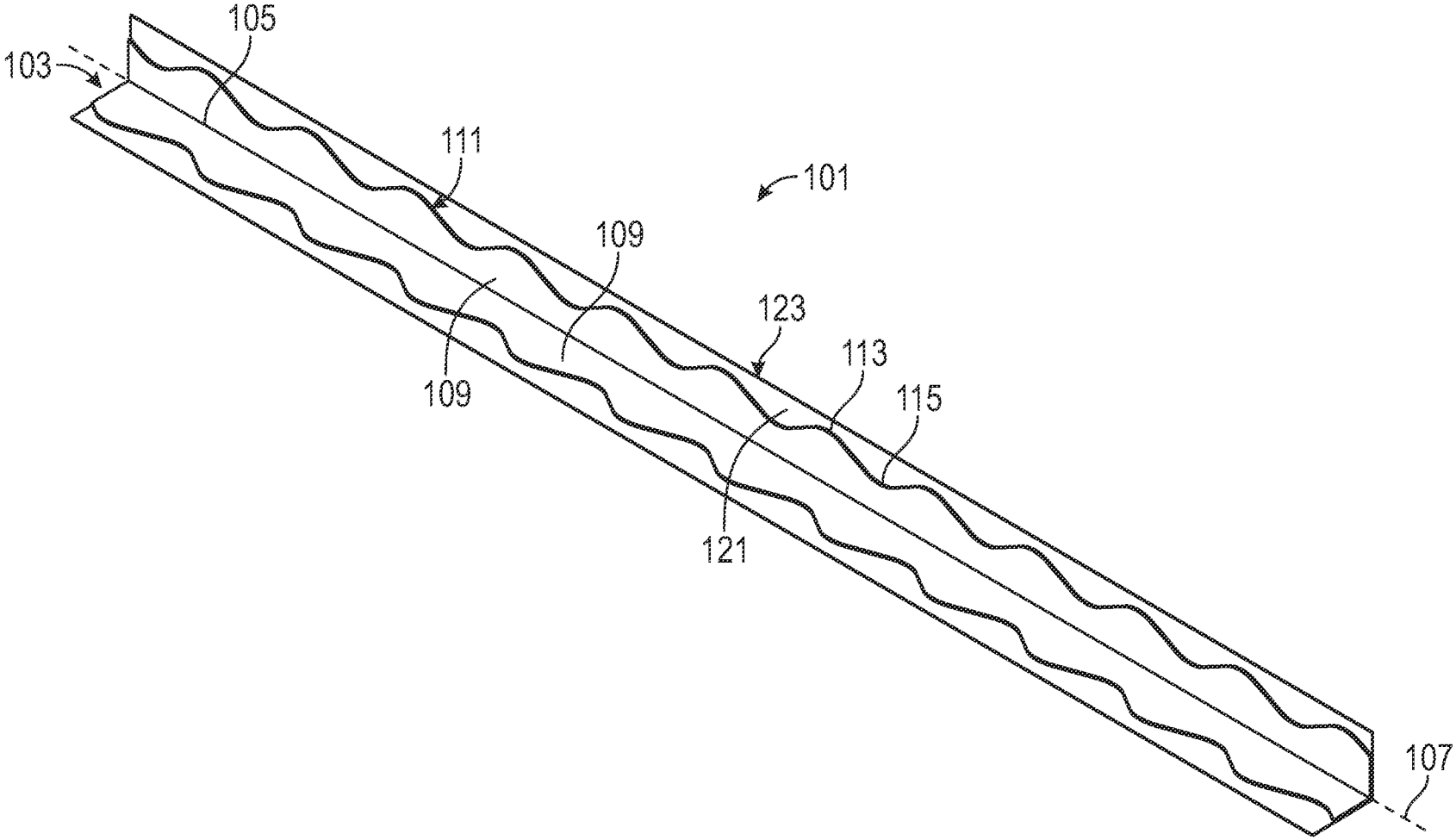
FIG. 12 is a front perspective view of a fourth embodiment of a cornerbead.
Figure 13:
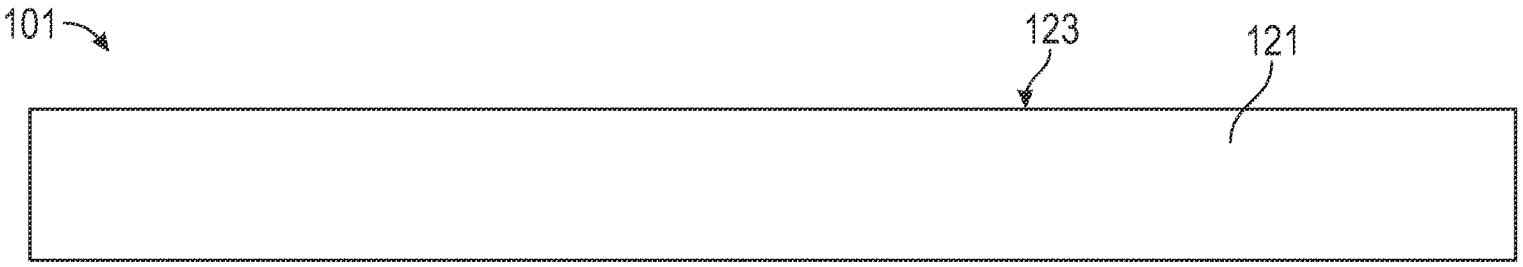
FIG. 13 is a rear view of the cornerbead of FIG. 12.
Figure 14:
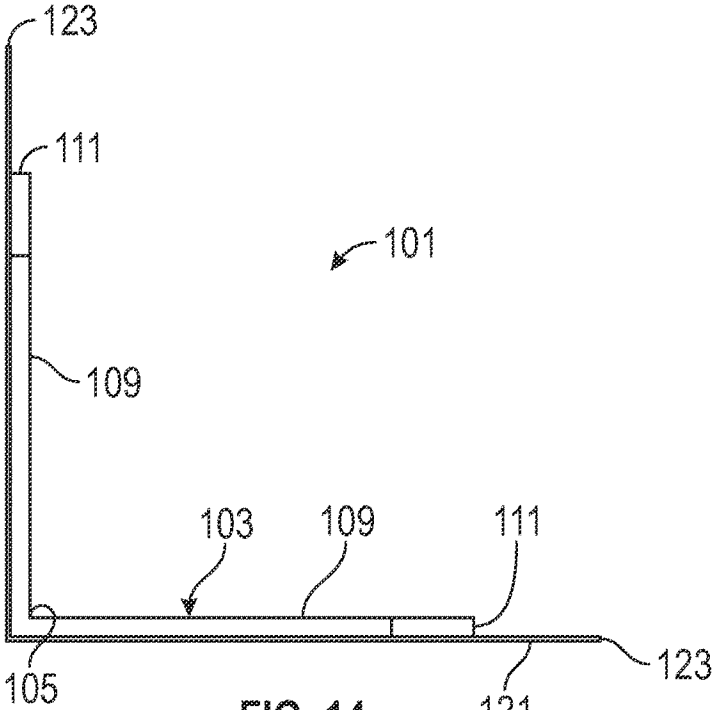
FIG. 14 is an end view of the cornerbead of FIG. 12.
Figure 15:
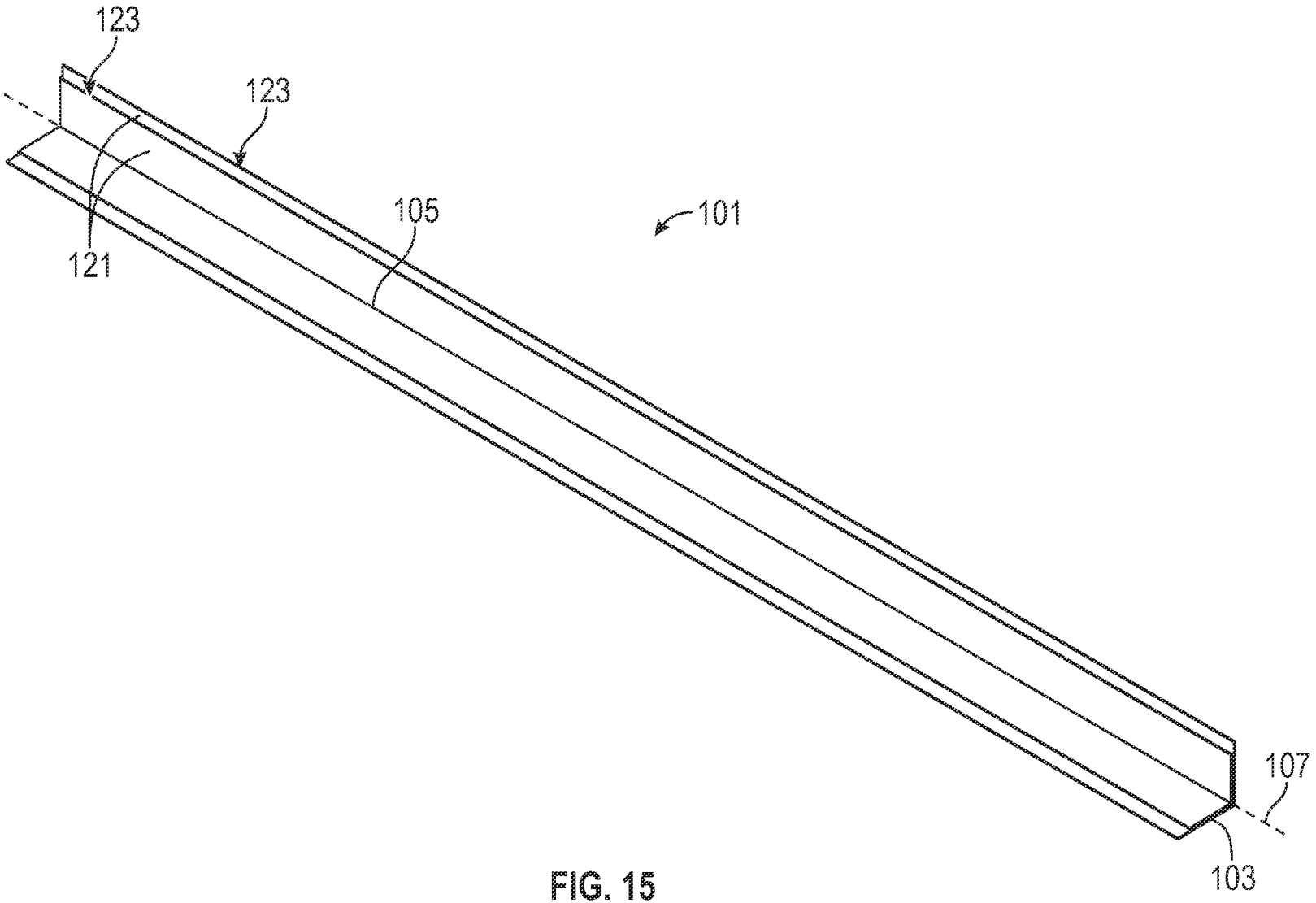
FIG. 15 is a front perspective view of a fifth embodiment of a cornerbead.
Figure 16:
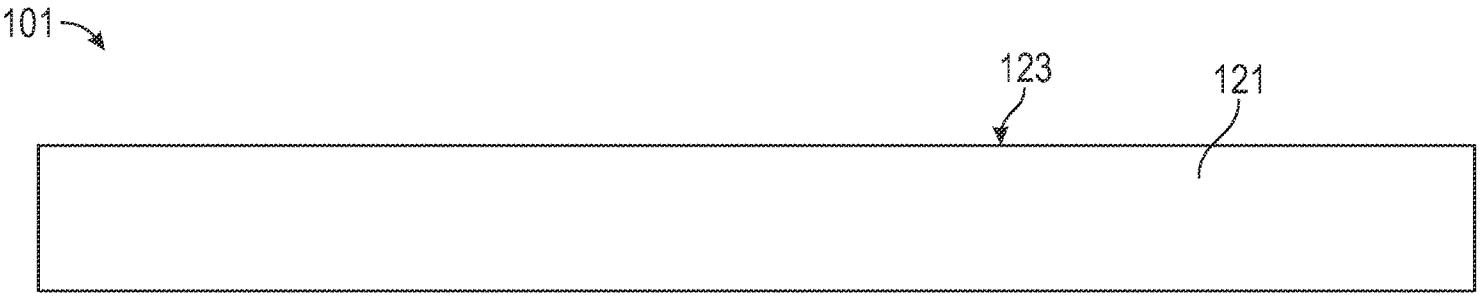
FIG. 16 is a rear view of the cornerbead of FIG. 15.
Figure 17:
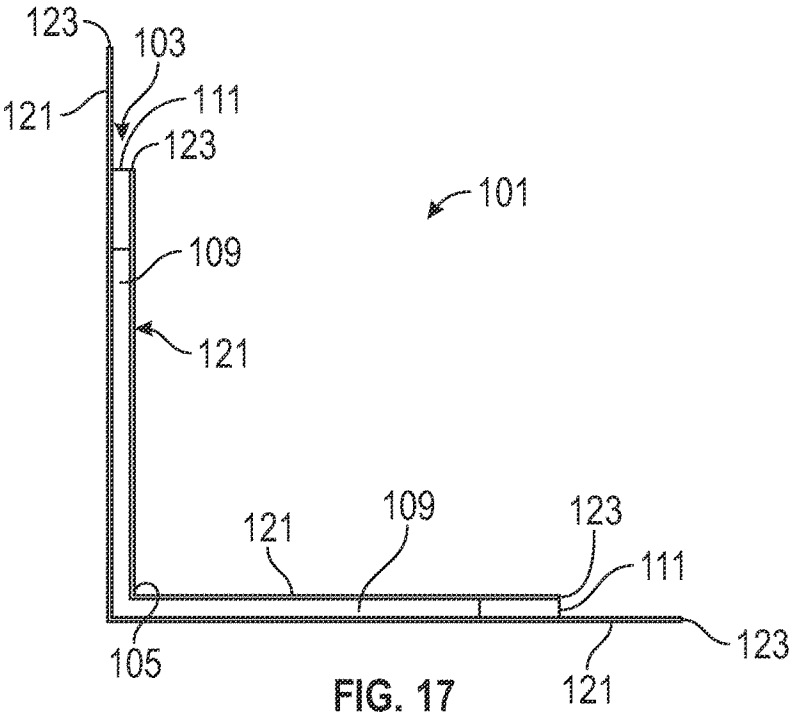
FIG. 17 is an end view of the cornerbead of FIG. 15.
Figure 18:
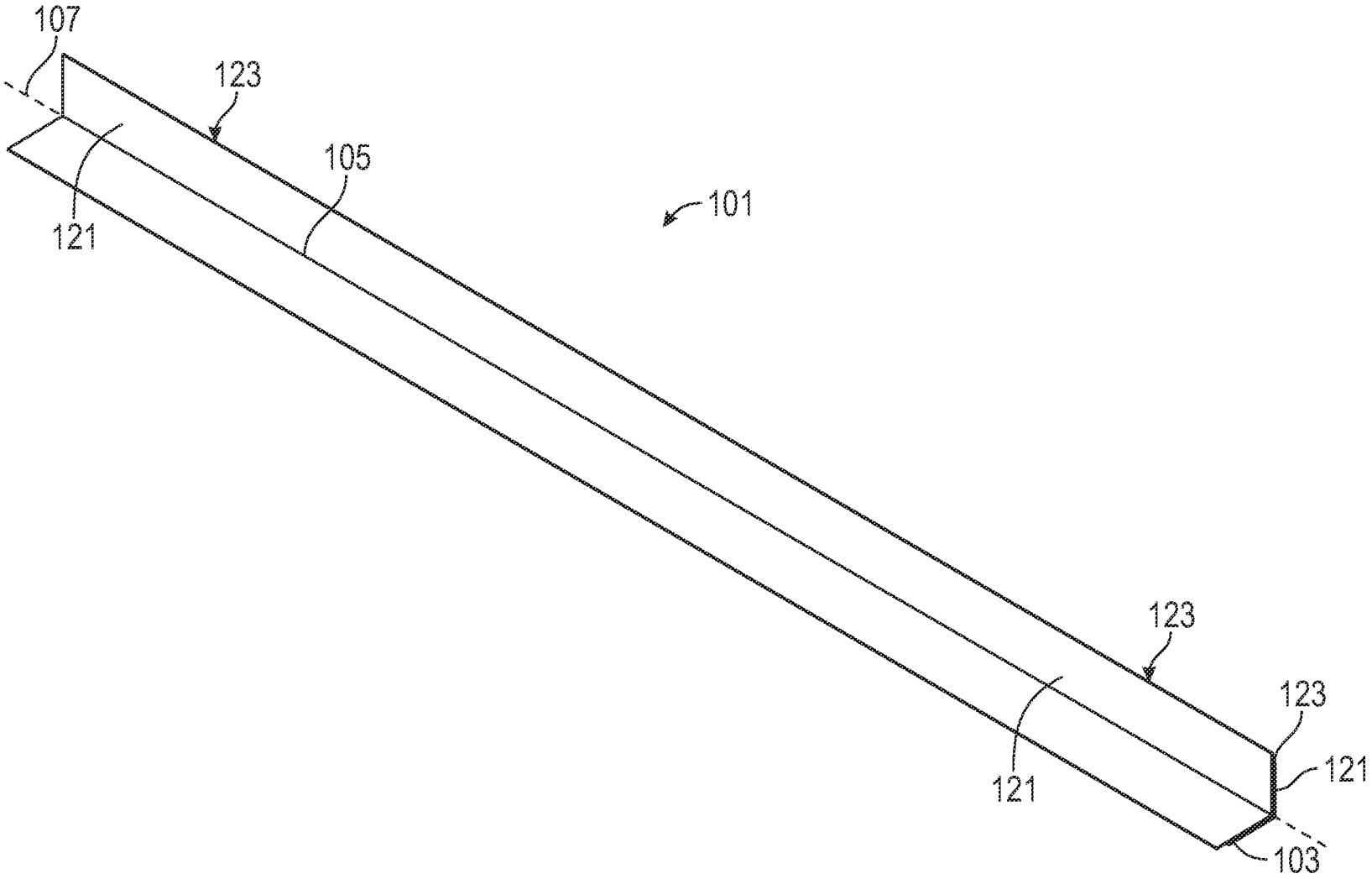
FIG. 18 is a front perspective view of a sixth embodiment of a cornerbead.
Figure 19:
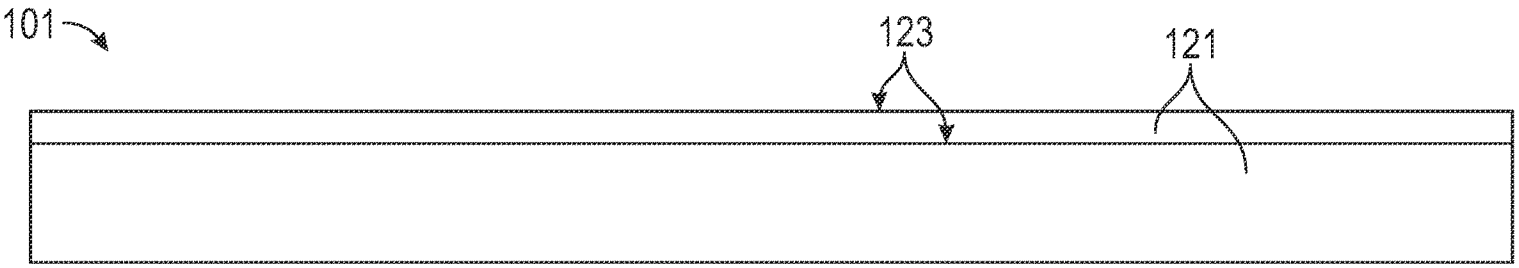
FIG. 19 is a rear view of the cornerbead of FIG. 18.
Figure 20:
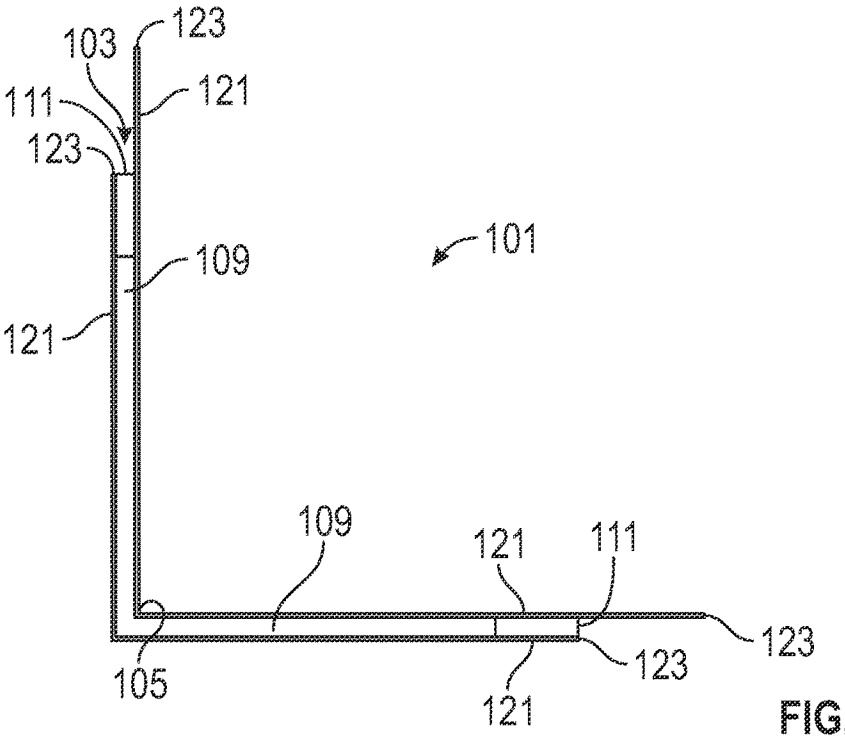
FIG. 20 is an end view of the cornerbead of FIG. 18.

The following descriptions of various implementations of the present teachings have been presented for purposes of illustration and description. It is not exhaustive and does not limit the present teachings to the precise form disclosed. Modifications and variations are possible in light of the above teachings or may be acquired from practicing of the present teachings.

Referring to FIGS. 1-20, embodiments of drywall trim for protecting drywall surfaces, corners, intersections, etc., are disclosed. The drywall trim can be a cornerbead or paperbead. For example, drywall trim 101 can include a plastic or metal (e.g., steel) body 103 comprising a seam 105, such as a bend, intersection, hinge or living hinge. The seam 105 can have a longitudinal axis 107. The metal body can further include wings, such as planar portions 109, which extend from the seam 105 in transverse directions relative to the longitudinal axis 107. The planar portions can be formed at an angle relative to each other, such orthogonal (e.g., 90 degrees) or non-orthogonal, or an acute or obtuse angle.

In some versions, at least one of the planar portions 109 can include an outer edge 111 that is not parallel to the seam 105. Examples can include both of the planar portions 109 having outer edges 111 that are not parallel to the seam 105. As shown in the embodiments of FIGS. 1-8, the outer edge 111 can be sinusoidal, or it can comprise waves. The outer edge 111 can include oscillations. For example, the oscillations can repeat in pattern having a range of about 6 inches to about 12 inches, relative to the longitudinal axis 107.

As shown in FIGS. 9-14, the outer edge 111 can be serrated. The serrations can comprise peaks 113 and valleys 115 that are radiused. For example, the radii can be in a range of about 0.1 inches to about 0.5 inches. The serrations can repeat in a pattern having a range of about 1 inch to about 2 inches, relative to the longitudinal axis 107.

In addition, at least one layer of paper 121 can be bonded to the metal body 103. The paper 121 can include paper outer edges 123. The paper outer edges 123 can be parallel to the seam 105. Alternatively, the paper outer edges 123 can be not parallel to the seam 105. In other versions, the paper outer edge 123 can be complementary in shape to the outer edge 111 of the metal body 103. As shown in FIG. 1, the paper 121 can be only on a convex side of the metal body 103. Alternatively, the paper 121 can be only on a concave side of the metal body 103.

In the embodiments of FIGS. 15-20, the paper 121 can comprise at least two layers. For example, the paper 121 can be on both the convex side and the concave side of the metal body 103. In some versions, both layers of the paper 121 can comprise a same transverse width. In other versions, the layers of paper 121 can comprise a different transverse width from each other. Other examples (FIGS. 15-20) include one layer of the paper 121 having a greater transverse width than the metal body 103, and the other layer of paper 121 having a same transverse width as the metal body 103. In still other examples, both layers of paper 121 can have a transverse width that is substantially equal to or greater than that of the metal body 103.

Embodiments include interior construction drywall industry, paper-faced cornerbead trims, edge, and seam finishes. Altering the edge cut of the metal portion of cornerbead, the product still performs as well as a traditional cornerbead, but lighter in weight and more manageable during installation. In contrast, traditional paper-faced cornerbead is made from straight flat strips of metal. The embodiments disclosed herein are novel and different in that the shape is altered at the outer edges in an oscillating or wavy manner. These designs reduce material cost and product weight without sacrificing any performance.

Additional information about drywall and drywall trim can be found at the catalog link at https://www.gibraltar-buildingproducts.com/norwesco, which is incorporated herein by reference in its entirety.

Other versions can include one or more of the following items.

1. A drywall trim for protecting drywall, the drywall trim comprising:

a metal body comprising a seam having a longitudinal axis and planar portions extending from the seam in transverse directions relative to the longitudinal axis, the planar portions being formed at an angle relative to each other, and at least one of the planar portions comprises an outer edge that is not parallel to the seam; and paper bonded to the metal body.

2. The drywall trim wherein both of the planar portions comprise outer edges that are not parallel to the seam.

3. The drywall trim wherein the outer edge is sinusoidal.

4. The drywall trim wherein the outer edge comprises waves.

5. The drywall trim wherein the outer edge comprises oscillations.

6. The drywall trim wherein the oscillations repeat in pattern having a range of about 6 inches to about 12 inches.

7. The drywall trim wherein the outer edge is serrated.

8. The drywall trim wherein the serrations comprises peaks and valleys that are radiused.

9. The drywall trim wherein the radii are in a range of about 0.1 inches to about 0.5 inches.

10. The drywall trim wherein the serrations repeat in pattern having a range of about 1 inch to about 2 inches.

11. The drywall trim wherein the metal body comprises steel.

12. The drywall trim wherein the planar portions are orthogonal relative to each other.

13. The drywall trim wherein the planar portions are non-orthogonal relative to each other.

14. The drywall trim wherein the planar portions are at an acute angle relative to each other.

15. The drywall trim wherein the planar portions are at an obtuse angle relative to each other.

16. The drywall trim wherein the paper comprises paper outer edges that are parallel to the seam.

17. The drywall trim wherein the paper comprises paper outer edges that are not parallel to the seam.

18. The drywall trim wherein the paper comprises a paper outer edge that is complementary in shape to the outer edge of the metal body.

19. The drywall trim wherein the paper is on a convex side of the metal body.

20. The drywall trim wherein the paper is on a concave side of the metal body.

21. The drywall trim wherein the paper comprises two layers on a convex side and a concave side, respectively, of the metal body.

22. The drywall trim wherein the two layers of paper comprise a same transverse width.

23. The drywall trim wherein the two layers of paper comprise a different transverse width.

24. The drywall trim wherein one layer of paper has a greater transverse width than the metal body.

25. The drywall trim wherein one layer of paper has a transverse width that is substantially equal to that of the metal body.

26. The drywall trim wherein the drywall trim comprises a cornerbead or paperbead.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," "top", "bottom," and the like, may be used herein for ease of description to describe one element's or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated degrees or at other orientations) and the spatially relative descriptions used herein interpreted accordingly.

This written description uses examples to disclose the embodiments, including the best mode, and also to enable those of ordinary skill in the art to make and use the invention. The patentable scope is defined by the claims, and can include other examples that occur to those skilled in the art. Such other examples are intended to be within the scope of the claims if they have structural elements that do not differ from the literal language of the claims, or if they include equivalent structural elements with insubstantial differences from the literal languages of the claims.

In the foregoing specification, the concepts have been described with reference to specific embodiments. However, one of ordinary skill in the art appreciates that various modifications and changes can be made without departing from the scope of the invention as set forth in the claims below. Accordingly, the specification and figures are to be regarded in an illustrative rather than a restrictive sense, and all such modifications are intended to be included within the scope of invention.

It can be advantageous to set forth definitions of certain words and phrases used throughout this patent document. The term "communicate," as well as derivatives thereof, encompasses both direct and indirect communication. The terms "include" and "comprise," as well as derivatives thereof, mean inclusion without limitation. The term "or" is inclusive, meaning and/or. The phrase "associated with," as well as derivatives thereof, can mean to include, be included within, interconnect with, contain, be contained within, connect to or with, couple to or with, be communicable with, cooperate with, interleave, juxtapose, be proximate to, be bound to or with, have, have a property of, have a relationship to or with, or the like. The phrase "at least one of," when used with a list of items, means that different combinations of one or more of the listed items can be used, and only one item in the list can be needed. For example, "at least one of: A, B, and C" includes any of the following combinations: A, B, C, A and B, A and C, B and C, and A and B and C.

Also, the use of "a" or "an" is employed to describe elements and components described herein. This is done merely for convenience and to give a general sense of the scope of the invention. This description should be read to include one or at least one and the singular also includes the plural unless it states otherwise.

The description in the present application should not be read as implying that any particular element, step, or function is an essential or critical element that must be included in the claim scope. The scope of patented subject matter is defined only by the allowed claims. Moreover, none of the claims invokes 35 U.S.C. § 112(f) with respect to any of the appended claims or claim elements unless the exact words "means for" or "step for" are explicitly used in the particular claim, followed by a participle phrase identifying a function.

Benefits, other advantages, and solutions to problems have been described above with regard to specific embodiments. However, the benefits, advantages, solutions to problems, and any feature(s) that can cause any benefit, advantage, or solution to occur or become more pronounced are not to be construed as a critical, required, sacrosanct or an essential feature of any or all the claims.

After reading the specification, skilled artisans will appreciate that certain features which are, for clarity, described herein in the context of separate embodiments, can also be provided in combination in a single embodiment. Conversely, various features that are, for brevity, described in the context of a single embodiment, can also be provided separately or in any sub-combination. Further, references to values stated in ranges include each and every value within that range.

What is claimed is:

1. A drywall trim for protecting drywall, the drywall trim comprising:

a metal body comprising a seam having a longitudinal axis and planar portions extending from the seam in transverse directions relative to the longitudinal axis, the planar portions being formed at an angle relative to each other, and at least one of the planar portions comprises a continuous outer edge that is sinusoidal having symmetrical peaks and valleys; and paper bonded to the metal body, wherein the paper comprises:

a first layer on a first side of the metal body, the first layer comprising a greater transverse width than the metal body and an outer edge that is complementary in shape to the outer edge of the metal body; and a second layer on a second side of the metal body opposite the first side.

2. The drywall trim of claim 1, wherein both of the planar portions comprise outer edges that are not parallel to the seam.

3. The drywall trim of claim 1, wherein the outer edge comprises waves.

4. The drywall trim of claim 1, wherein the outer edge comprises oscillations.

5. The drywall trim of claim 4, wherein the oscillations repeat in pattern having a range of about 6 inches to about 12 inches.

6. The drywall trim of claim 1, wherein the outer edge is serrated.

7. The drywall trim of claim 6, wherein the serrations comprises the peaks and the valleys that are radiused.

8. The drywall trim of claim 7, wherein the radii are in a range of about 0.1 inches to about 0.5 inches.

9. The drywall trim of claim 6, wherein the serrations repeat in pattern having a range of about 1 inch to about 2 inches.

10. The drywall trim of claim 1, wherein the metal body comprises steel.

11. The drywall trim of claim 1, wherein the planar portions are orthogonal relative to each other.

12. The drywall trim of claim 1, wherein the planar portions are non-orthogonal relative to each other.

13. The drywall trim of claim 1, wherein the planar portions are at an acute angle relative to each other.

14. The drywall trim of claim 1, wherein the planar portions are at an obtuse angle relative to each other.

15. The drywall trim of claim 1, wherein the paper comprises paper outer edges that are not parallel to the seam.

16. The drywall trim of claim 1, wherein the first side is a convex side of the metal body.

17. The drywall trim of claim 16, wherein the second side is a concave side of the metal body.

18. The drywall trim of claim 17, wherein the second layer has a transverse width that is substantially equal to that of the metal body.

19. The drywall trim of claim 1, wherein the first side is a concave side of the metal body.

20. The drywall trim of claim 19, wherein the second side is a convex side of the metal body.

21. The drywall trim of claim 20, wherein the second layer has a transverse width that is substantially equal to that of the metal body.

22. The drywall trim of claim 1, wherein the first and second layers of paper comprise a same transverse width.

23. The drywall trim of claim 1, wherein the first and second layers of paper comprise a different transverse width.

24. The drywall trim of claim 1, wherein the second layer has a transverse width that is substantially equal to that of the metal body.

25. The drywall trim of claim 1, wherein the drywall trim comprises a cornerbead or paperbead.

* * * * *